United States Patent [19]

Cohen

[11] 4,095,817

[45] Jun. 20, 1978

[54] WHEELIE SKATEBOARD

[75] Inventor: Daniel R. Cohen, Port Washington, N.Y.

[73] Assignee: Gustave Miller, Miami, Fla.

[21] Appl. No.: 713,676

[22] Filed: Aug. 12, 1976

[51] Int. Cl.[2] ..... A63C 17/04

[52] U.S. Cl. ..... 280/87.04 A

[58] Field of Search ..... 280/87.04 A, 87.04 R, 280/11.2, 11.1 BT, 11.1 R, 11.28, 11.27; D34/15 AJ; 272/70, 96

[56] References Cited

U.S. PATENT DOCUMENTS

| | | | |
|---|---|---|---|
| D. 212,105 | 8/1968 | Persinger et al. | D34/15 AJ |
| 2,253,012 | 8/1941 | Benner et al. | 280/11.1 BT |
| 2,427,572 | 9/1947 | Phares | 280/11.19 |
| 3,399,904 | 9/1968 | Schinke | 280/87.04 A |
| 3,442,528 | 5/1969 | Rademacher | 280/87.04 A |
| 3,565,454 | 2/1971 | Stevenson | 280/87.04 A |
| 3,630,540 | 12/1971 | Smith | 280/87.04 A |
| 3,990,713 | 11/1976 | Hokanson | 280/87.04 A |
| 4,040,639 | 8/1977 | Scardenzan | 280/87.04 A |

FOREIGN PATENT DOCUMENTS

| | | | |
|---|---|---|---|
| 1,215,053 | 4/1960 | France | 280/87.04 A |
| 616,723 | 1/1949 | United Kingdom | 280/87.04 A |

OTHER PUBLICATIONS

Playthings, 2/1976, Toy Fair Edition, p. 184.

*Primary Examiner*—David M. Mitchell
*Attorney, Agent, or Firm*—Gustave Miller

[57] ABSTRACT

This device is a wheelie skateboard and consists of a more or less conventional skateboard to which is added a rearward upwardly inclined kicktail. Conventional skateboard wheels are mounted on the bottom of the conventional skateboard section. In this device, a third pair of wheels are mounted on the bottom of the inclined kicktail section.

1 Claim, 4 Drawing Figures

WHEELIE SKATEBOARD

OBJECTS OF THE INVENTION

It is an object of this invention to provide an improved skateboard which facilitates the operator to practice a wheelie maneuver and, at the same time, substantially diminish the danger of a spill while the operator is doing a wheelie maneuver or the like.

Still, a further object of this invention is to provide a wheelie skateboard that is an improvement of the skateboard of U.S. Pat. No. 3,565,454, as well as over all other prior art, including U.S. Pat. Nos. 3,630,540 and 2,253,012.

Yet a further object of this invention is to provide a wheelie skateboard with an inclined upwardly extending kicktail section and wheel means depending from the kicktail section to facilitate wheelie maneuvers of the operator.

Still a further object of this invention is to provide an extra set of wheel means and an extended inclined kicktail section on an otherwise conventional skateboard.

A still further object of this invention is to provide a wheelie skateboard on which the operator may ride in a conventional manner on the normal spaced apart wheels supporting the front and rear sections of an otherwise normal skateboard platfrom, or may perform a substantially straight ahead wheelie maneuver by shifting his weight from the otherwise normal skateboard platform to an upwardly inclined kicktail section extending from the rear end of the otherwise normal skateboard platform to thereby be supported by the rear wheels of the otherwise normal skateboard platform and the wheels under the kicktail section now rolling on the riding surface.

BRIEF SUMMARY OF THE INVENTION

Briefly stated, this invention comprehends a skateboard constructed to assist a person in developing and enhancing balance and athletic skills with an accompanying diminished danger of tumbling from the skateboard and becoming injured, by adding an upwardly inclined rear kicktail section extending rearwardly from the normal platform, the kicktail extension having wheel means coupled to its bottom, and extending rearwardly therefrom, so that the skateboard is ridden conventionally on its usual front and rear wheels, or it may be maneuvered in a wheelie action by tilting the wheelie skateboard so that it will roll on its second conventional wheels and the kicktail wheel rolling on the wheels supporting surface.

This wheelie skateboard is characterized by an elongated platform normally extending in substantially a single plane and an upwardly inclined kicktail section integrally extending from the rear of the normal single plane platform section and smoothly merging therewith. Wheels are conventionally coupled to and positioned beneath the forward end section and the rearward end section of the single plane elongated platform section, and, in addition, another set of wheels are similarly secured on the bottom of the kicktail section, the operator riding either on the wheels beneath the elongated single plane normal platform section, or on the rear wheels of the single plane normal platform section and the wheels of the kicktail section.

To alter the skateboard from its normal traveling position and prepare it for a wheelie maneuver, for example, the operator shifts his weight and slides his foot rearwardly so that the skateboard is then supported on the kicktail wheels and the rear wheels of the single plane normal platform section. To maneuver the skateboard 10, the operator first slides his foot and shifts his weight forward onto the conventionally single plane normal platform section.

BRIEF DESCRIPTION OF THE DRAWING

With the above and other objects in view, this invention consists in the details of construction and combinations of parts, as will be more fully understood from the following description, when read in conjunction with the accompanying drawing, in which.

DETAILED DESCRIPTION OF THE INVENTION

Figure 1:
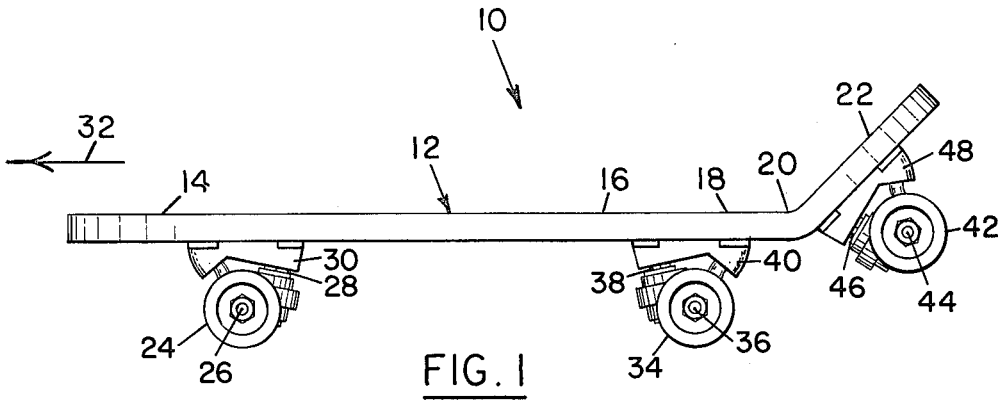
FIG. 1 is a side elevation of the wheelie skateboard.
Figure 2:
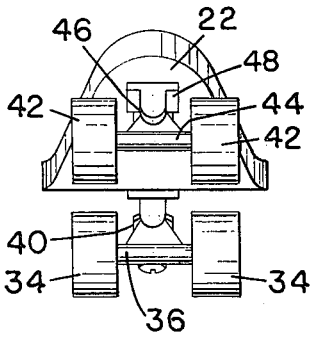
FIG. 2 is a rear elevation of the form in FIG. 1, having two wheels in the rear inclined or kicktail section.

Referring to FIGS. 1 and 2, there is shown a wheelie skateboard 10 constructed with a flat elongated normal single plane platform 12 having a forward end section 14, a longitudinal center line section 16 and a rear end section 18. Extending upwardly from the rear end 20 of rear section 18 is an inclined kicktail section 22.

A pair of conventional skateboard wheels 24 journaled on a common axle 26 are mounted at 28 and extend forwardly from a bracket 30 secured to and supporting the bottom of forward skateboard section 14, the forward direction of travel being shown by the arrow 32. Another pair of wheels 34 on a common axle 36 are mounted at 38 to extend rearwardly from a bracket 40 secured to and supporting the bottom of the rearward skateboard section 18.

A third similar pair of wheels 42 journaled on a similar common axle 44 is mounted at 46 to bracket 48 secured to and depending from the bottom of upwardly extending inclined kicktail section 22.

OPERATION OF THE INVENTION

In operation, the operator may stand on the flat elongated normal single plane platform 12 and operate this skateboard 10 in the conventional manner of any skateboard with the forward wheels 24 and the rearward wheels 34 providing the rolling support as usual. To activate the skateboard 10 for a wheelie maneuver, the operator shifts his feet to place one foot on the kicktail section 22, and then controllably shifts his weight from the foot still on the flat elongated normal single platform section 12 to the foot on the kicktail section 22, thus causing the platform section 12 to rise upwardly as the kicktail section descends to bring its wheels 42 into supporting rolling contact with the surface on which the skateboard is riding for safe straight ahead travel. To maneuver the skateboard 10, the operator first shifts his weight onto the single plane platform section 12.

ABSTRACT OF THE DRAWING

In the drawing, like numbers refer to like parts, and for the purpose of explication, set forth below are the numbered parts of the improved WHEELIE SKATEBOARD of this invention.

10 wheelie skateboard
12 flat elongated normal single plane platform
14 forward end section
16 longitudinal center line section
18 rear end section
20 rear end of 18

22 upwardly rearwardly extending inclined kicktail section
≧forward wheels
26 common axle for 24
28 forwardly extending swivel mounting
30 forward bracket
32 arrow showing direction of travel
34 rear wheels
36 axle for 34
38 rearwardly extending wheel mounting
40 rear bracket under 18
42 third pair of wheels, under 22
44 axle for 42
46 mounting for 44
48 bracket under 22

Although this invention has been described in detail, such description is intended as being illustrative rather than limiting since the invention may be variously embodied.

Having thus set forth and disclosed the nature of this invention, what is claimed is:

1. A wheelie skateboard (10) comprising an elongated platform (12) for supporting a person, the platform having a forward end section (14), a longitudinal center line section (16) and a rear end section (18) in approximately the same plane with said forward (14) and center line (16) sections, and an inclined kicktail section (24) extending integrally upwardly and rearwardly from said platform end section (18) and merging smoothly therewith, a first pair of wheels (24) and a common axle (26) coupled to and positioned beneath said platform forward end section (14), a second pair of wheels (34) and a common axle (36) therefor coupled to and positioned beneath said platform rearward end section (18), and a third pair of wheels (42) and a common axle (44) therefor coupled to and and positioned beneath said kicktail section (22), whereby a person positioned on said platform (12) forward of said kicktail section (22) may ride on said skateboard supported on said first (24) and second (34) pairs of wheels (24 and 34), or positioned at least partly on said kicktail section (22) may ride said skateboard (10) supported on said second (34) and third (42) pairs of wheels.

* * * * *

UNITED STATES PATENT OFFICE

CERTIFICATE OF CORRECTION

Patent No. 4,095,817 Dated June 20, 1978

Inventor(s) Daniel R. Cohen

It is certified that error appears in the above-identified patent and that said Letters Patent are hereby corrected as shown below:

On the title page, item "(73) Assignee Gustave Miller Miami, Florida"

should read

-- Gustave Miller, a part interest --.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*